United States Patent [19]

Luetzow

[11] Patent Number: 4,656,448

[45] Date of Patent: Apr. 7, 1987

[54] SOLENOID FOR USE IN HARSH ENVIRONMENT CONDITIONS

[75] Inventor: Edwin J. Luetzow, Framington, Minn.

[73] Assignee: Minnesota Technical Research, Farmington, Minn.

[21] Appl. No.: 677,980

[22] Filed: Dec. 4, 1984

[51] Int. Cl.[4] ..... H01F 7/08

[52] U.S. Cl. ..... 335/262; 335/269

[58] Field of Search ..... 335/257, 258, 260, 261, 335/262, 269

[56] References Cited

U.S. PATENT DOCUMENTS

| | | | |
|---|---|---|---|
| 3,510,814 | 5/1970 | Nordfors | 335/262 |
| 4,131,866 | 12/1978 | Torr | 335/262 |
| 4,233,585 | 11/1980 | Sugimoto et al. | 335/262 |
| 4,518,938 | 5/1985 | Bartholomaus et al. | 335/262 |

*Primary Examiner*—George Harris
*Attorney, Agent, or Firm*—Hugh D. Jaeger

[57] ABSTRACT

Solenoid for use in harsh difficult environmental conditions for actuation in a pulling motion along a straight line where the magnetic core travels within a stainless steel non-magnetic sleeve. The core uses a plurality of broad Teflon rings fitted in broad annular grooves to reduce friction and wear along its path of travel, to reduce cross-section tangential point to point contact wear, and to prevent sacrificial corrosion of the moveable magnetic core or sleeve due to galvanic action when moisture is present. The core is zinc coated and the sleeve is stainless steel for the prevention of corrosion and rust in order to ensure a smooth and contaminant free inner surface for proper and unhampered movement of the core. Annular Teflon bearings are utilized, as moisture will not cause the Teflon bearing to freeze in low temperature applications.

1 Claim, 4 Drawing Figures

SOLENOID FOR USE IN HARSH ENVIRONMENT CONDITIONS

CROSS REFERENCES TO CO-PENDING APPLICATIONS

BACKGROUND OF THE INVENTION

1. Field of the Invention

The present invention pertains to a solenoid, and more particularly pertains to a low friction solenoid core incorporating Teflon bearings for use in harsh environmental conditions.

2. Description of the Prior Art

Prior art solenoids have tended to have high coefficients of internal mechanical friction due to lack of low coefficient of friction core or sleeve materials. Tangential wear points have often surfaced when the solenoid has been mounted in any other than a vertical position, wearing through the sleeve or otherwise causing abnormal wear which ultimately renders the solenoid to have less pulling force available or even to cease operation due to excess internal wear or coil fatigue.

Prior art devices, through improper wear patterns, have had plated exposed metal allowing the exposed surfaces to become rusty or corroded, or both, causing an irregular, bumpy, and high coefficient of friction surface over which the moveable core has a difficult time in passing over. With any moisture inside of the sleeve, galvanic action allows for sacrificial corrosion of both the core and sleeve of the solenoid, as well as freezing to the core and sleeve thereby impeding or stopping action of the solenoid.

The present invention overcomes the disadvantages of the prior art by providing a solenoid using low friction Teflon bearings mounted on the moveable core of the solenoid assembly.

SUMMARY OF THE INVENTION

The general purpose of the present invention is to provide a solenoid which includes annular Teflon rings fitted about grooves of the magnetic core to decrease frictional movement of the core, to decrease internal wear and tear of the solenoid, and to allow for use in hard and difficult environmental conditions.

According to one embodiment of the present invention, there are two flanged brackets including body holes, mounting holes, and feet; case positioning tabs, the rear most bracket which includes positioning holes and pins; terminal post holes for passage of terminal insulators and electric terminal posts; a plurality of washers with corresponding positioning holes and pins, juxtaposed inwardly from the flanged brackets in alignment with a stainless steel non-magnetic sleeve; locknuts and washers on the electrical terminal posts; a steel case with a bottom lock tab seam including wax filler holes and caps, which fits over and about the washers, as well as between the flanged brackets; the stainless steel non-magnetic sleeve including annular grooves for fixation of a shouldered collar, a snap ring and a shouldered conical core seat, the snap ring seated within the outer annular groove and the shouldered collar fixed with its annular ring engaged in the annular ring of the non-magnetic sleeve; the conical core seat being fixed through annular grooves engaged into the end of the sleeve and a machine bolt which secures the shouldered end of the conical case seat to the rear washers and rear bracket; an oil resistant rubber seal which secures over the front end of the sleeve and the actuator rod; a soft magnetic zinc plated core with a conical end which, when actuated, seats the conical end within the conical shaped core seat; broad annular grooves in the core and broad heat shrunk Teflon rings seated within the broad annular grooves; a threaded hole and a threaded actuating rod including an actuating rod linkage hole and a rod adjustment nut and hardware; a space between the moveable core and the sleeve including a Lexan bobbin fitted over the sleeve, and an electrical actuating coil wound over the bobbin and terminating at bracket mounted binding posts; and high melting point wax dielectric contained between the case and the coil.

One significant aspect and feature of the present invention is to provide a solenoid with a moveable core having Teflon bearings, whereupon friction between the moveable core and the sleeve is substantially reduced and distributed around the inner circumference of the sleeve allowing for more efficient and trouble free operation.

Another significant aspect and feature of the present invention is to provide a solenoid that eliminates or reduces the problem of having a water contaminated solenoid freeze up during cold weather or inclement weather during the operation of cars, trucks, refrigerator units, or other mechanical machines. This type of solenoid can be used on refrigeration units which are used on semi trailers.

A further significant aspect and feature of the present invention is to provide a solenoid that produces a minimum, or no internal contamination of the sleeve walls by preventing galvanic sacrificial corrosion, when moisture is present, by the physical separation of core and sleeve, both dissimular metals, by the use of Teflon core bearings.

A yet further significant aspect and feature of the present invention is to provide a solenoid which has Teflon to metal moving parts which reduces greatly the wearing off of anti-corrosive metal platings.

Having thus described the embodiments of the present invention, it is a principal object hereof to provide a solenoid with near frictionless bearings.

One object of the present invention is to provide a solenoid with a moveable core which incorporates annular Teflon bearings, which greatly and significantly reduces sliding friction between the moveable center core and the core housing sleeve.

Another object of the present invention is a solenoid which by the use of Teflon bearings eliminates or greatly reduces internal corrosion by sacrificial galvanic action with moisture present by the electorphysical separation of the moveable core from the sleeve, thus providing for smoother solenoid action and longer solenoid use-life.

A further object of the present invention is a solenoid which operates in any climatic condition regardless of temperature, moisture, or dirt content of the air.

BRIEF DESCRIPTION OF THE DRAWINGS

Other objects, and many of the attendant advantages of this invention, will be readily appreciated as the same becomes better understood by reference to the following detailed description when considered in connection with the accompanying drawings, in which like reference numerals designate like parts through the figures thereof and wherein.

DESCRIPTION OF THE PREFERRED EMBODIMENTS

Figure 1:
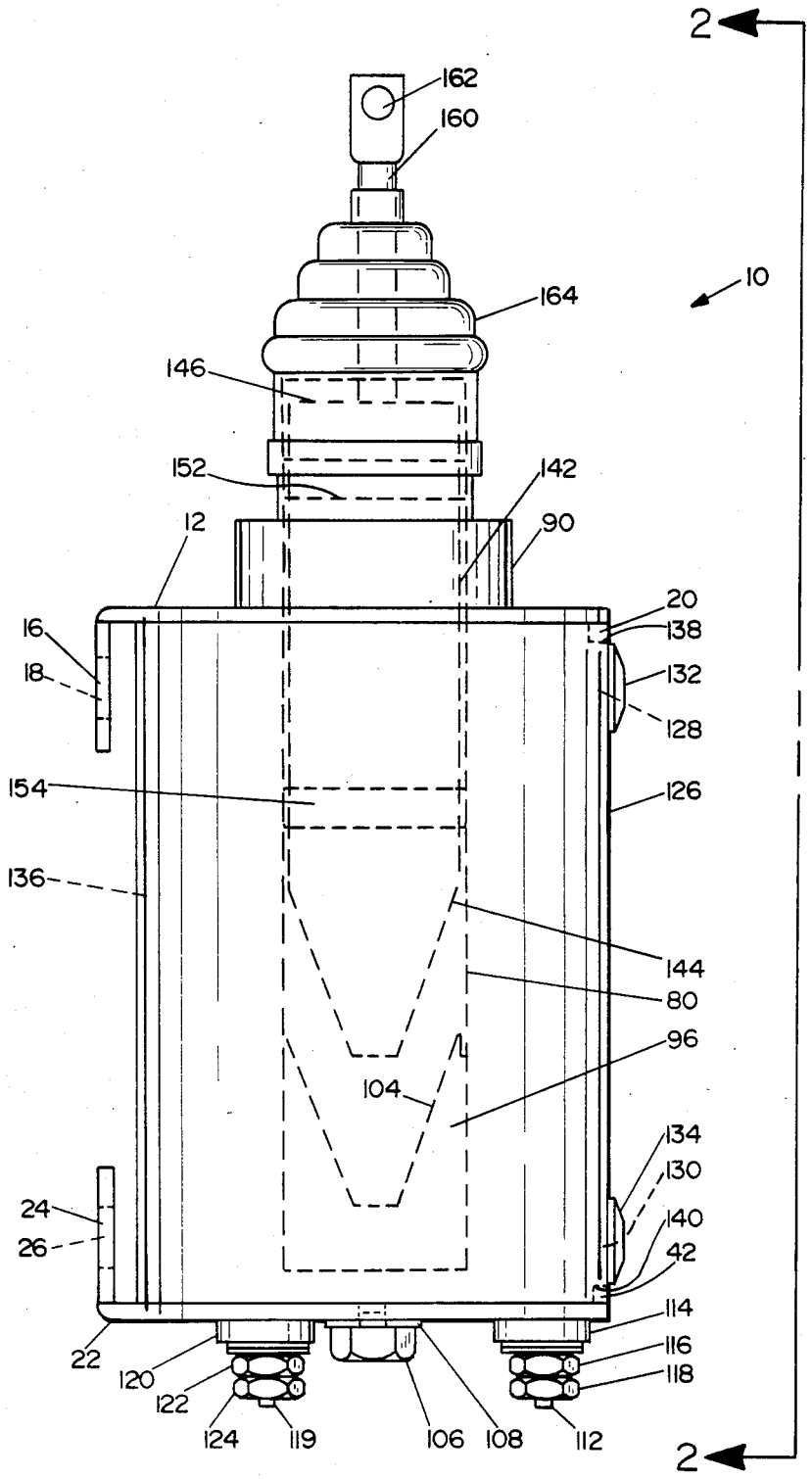
FIG. 1 illustrates a plan view of a solenoid, the present invention.

FIG. 1 illustrates a plan view of a solenoid 10 in the actuated position, including front angled flange 12, rear angled flange 22, cylindrical case 126 mounted between angled flanges 12 and 22, and cylindrical collar 90 which mounts on front angled flange 12. Stainless steel, non-magnetic sleeve 80, shown in hidden lines, passes through and is secured to collar 90, as described later, and extends inwardly and concentrically through the front angled flange 12 toward rear angled flange 22. Magnetic core seat 96, shown in hidden lines, with angled conical seat stop surface 104, is secured within the inner rear portion of the stainless steel, non-magnetic sleeve 80. An oil resistant flexible rubber seal 164 fits over the front outboard end of sleeve 80 for the purpose of preventing contaminants from reaching the inner portions of sleeve 80 and an actuator rod as later described. A soft steel, magnetic core 142, shown in hidden lines, including front Teflon ring 152, rear Teflon ring 154, conical end 144, and threaded actuator rod 160 slides within stainless steel, magnetic sleeve 80. Wax filler hole caps 132 and 134 mount in wax filler holes 128 and 130, respectively, as also illustrated in FIG. 2.

Figure 2:
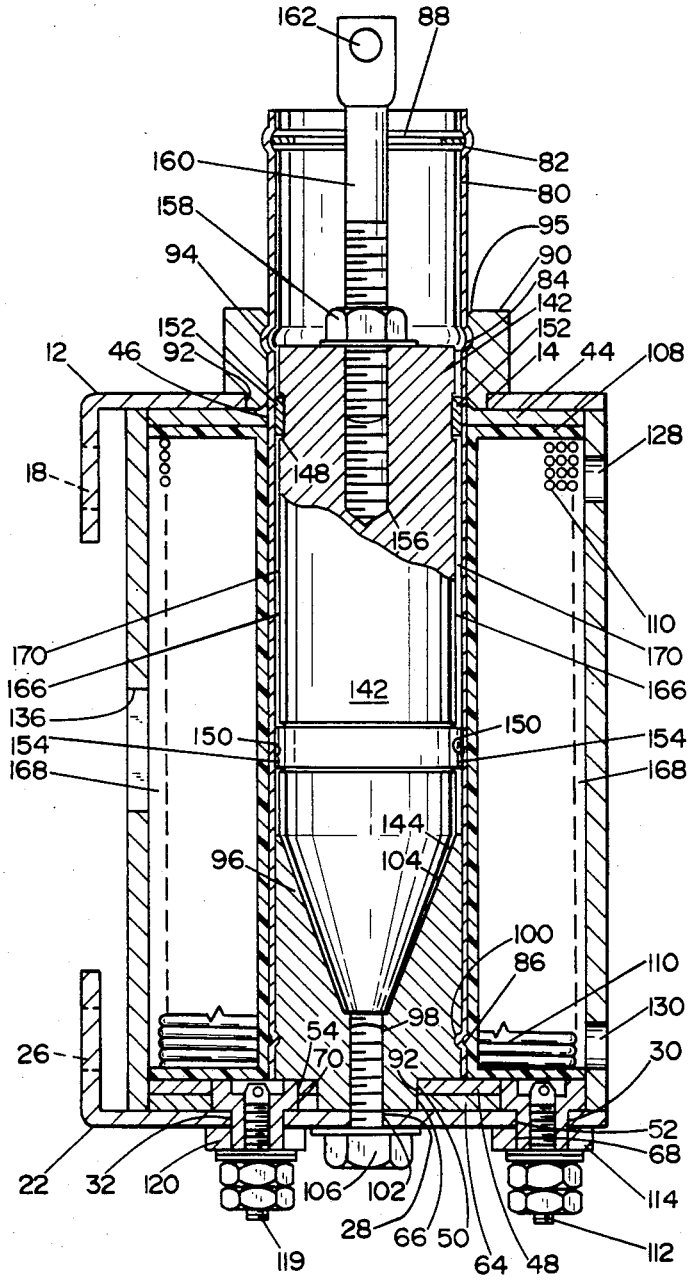
FIG. 2 illustrates a cross-section view of FIG. 1.
Figure 4:
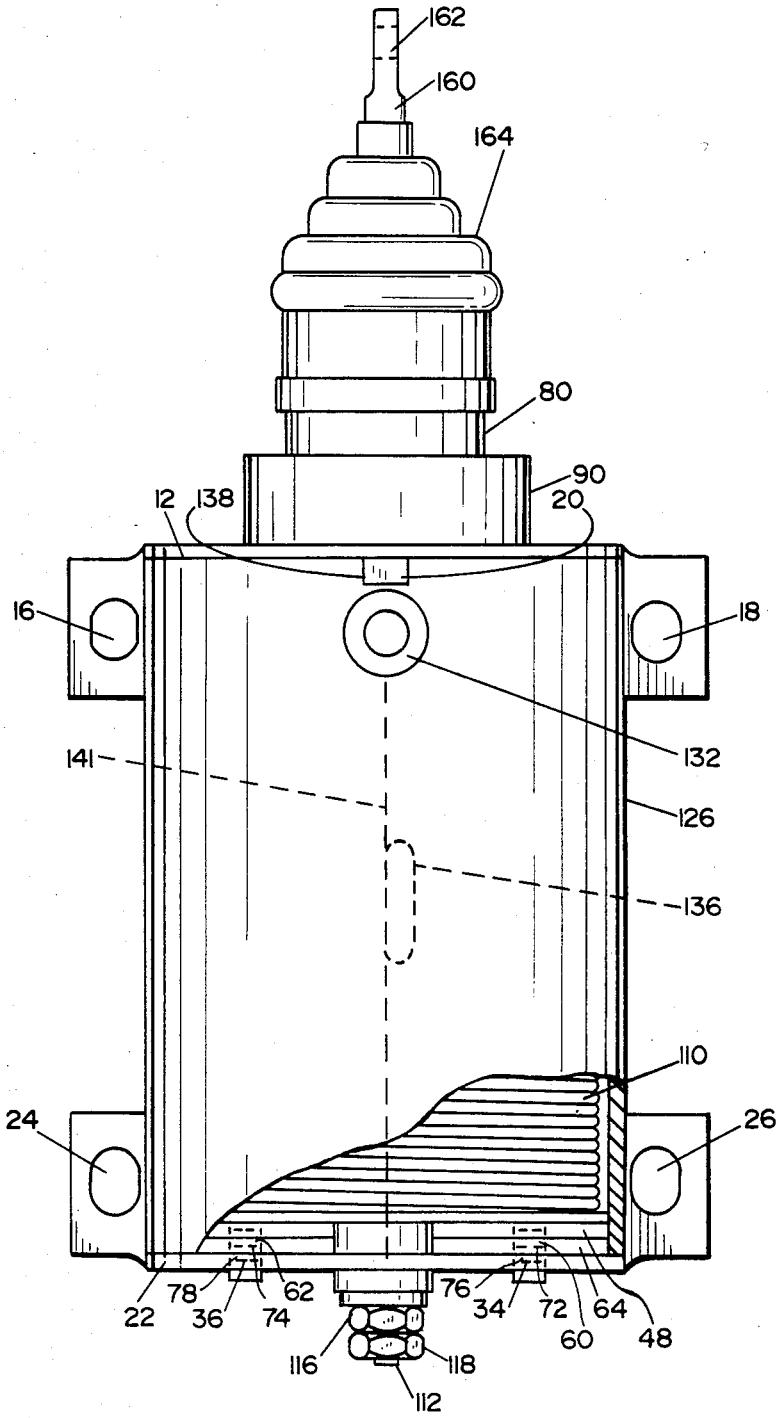
FIG. 4 illustrates a partial cutaway top view of FIG. 1.

FIG. 2 illustrates a cross-section view of FIG. 1 where all numerals correspond to those elements previously described. The front angled mounting flanged bracket 12 includes a large mounting hole 14, into which shoulder 92 of collar 90 engages; mounting holes 16 and 18; and positioning tab 20 of FIG. 4. Rear angled mounting flanged bracket 22 includes mounting holes 24 and 26, body hole 28, square terminals post holes 30 and 32, positioning pins and holes 38 and 40 and 34 and 36, respectively, as shown later in FIG. 4, and positioning tab 42 which is also shown in FIG. 4. Front washer 44 positions next to and inwardly from front flanged bracket 12 and includes a circular hole 46 which encompasses stainless steel, non-magnetic sleeve 80. Rear washers 48 and 64 position inwardly from and next to rear flanged bracket 22, both containing similar center body holes 50 and 66, U-shaped binding post holes 52 and 68, respectively, and binding post holes 54 and 70, respectively.

A stainless steel, non-magnetic sleeve or tube 80 positions through front bracket 12, hole 46 of front washer 44, polycarbonate coil bobbin 108, and butts up adjacent to rear washer 48. Sleeve 80 incorporates a front annular groove 82 for placement of containment snap ring 88, annular collar grove 84, and rear groove 86. Magnetic case seat 96, including conical surface 104, threaded hole 98, and annular groove 100 which engages sleeve roll formed groove 86, positions in the inner end of sleeve 80. Machine bolt 106, with associated hardware, extends through body hole 28 engaging the threaded hole 98 insuring firm engagement of the machined collar 92, of magnetic case seat 96, within holes 50 and 66 of washers 48 and 64, thus effectively centering and securing the inboard end of sleeve 80 and the case seat 96 to the mounting bracket 22. Shoulder 92 of collar 90 engages in hole 14 of bracket 12 centering the front outboard portion of sleeve 80 to and within bracket 12 while roll formed collar groove 84 engages collar groove 94 for fixation of the sleeve 80 to the collar 90.

Steel case 126 positions over and about washers 44, 48 and 64, bobbin 108, coil 110 and includes wax filler holes 128 and 130, filler caps 132 and 134, and lock tab seam 136, along with positioning tab receptacles 138 and 140 illustrated in FIG. 4.

An electrical solenoid coil 110 is wound around a Lexan bobbin 108 where ends connect to upper threaded terminal post 112 and lower threaded terminal post 119. Two-part plastic insulators 114 and 120 pass through square holes 30 and 32, insulating terminal 112 with nut 116, locking nut 118, and associated hardware, and terminal 119, nut 122, locknut 122 with associated hardware preventing contact with any metal conductive parts of the solenoid 10. A high melting point wax dielectric material 168 surrounds coil 110 which is contained by case 126 and is injected through filler holes 128 and 130 of case 126.

Soft steel, magnet core 142 with a zinc coating 166, is contained within and travels within stainless steel, non-magnetic case 80 and consists of conical end 144; circumferential rear groove 150; heat shrunk fitted rear Teflon circular bearing 154, which seats in rear groove 150; front circumferential groove 148; heat shrunk fitted front Teflon circular bearing 152, which is of sufficient width to pass smoothly and easily through or over collar groove area 84; threaded hole 156; an actuator rod 160; securing and adjustment nut 158 and appropriate associated hardware, and; an actuator rod fastener hole 162. The ferrous core 142 is zinc coated to prevent rust, and does not in itself ride upon the stainless steel, non-magnetic case 80, but slides within the inner circumference of case 80 by the circumferential Teflon bearings 152 and 154 which provides Teflon plastic to metal contact instead of metal to metal sliding or stationary contact, as evidenced by space 166. Any other like material with the same qualities can be substituted for the Teflon material of the bearings 152 and 154 where the material would have a low coefficient of friction and stand up in rugged environments and rugged operating conditions.

Figure 3:
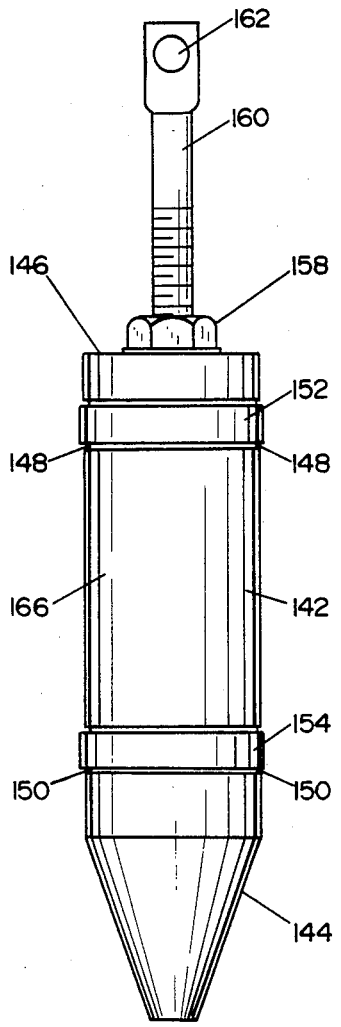
FIG. 3 illustrates a view of the magnetic core.

FIG. 3 illustrates a view of the magnetic case where all numerals correspond to those elements previously described. Of particular significance are the bearings 152 and 154 of Teflon material.

FIG. 4 illustrates a partial cutaway view of FIG. 1 where all numerals correspond to those elements previously described. Particular note is made of lock tab seam 136 shown in hidden lines running along the bottom seam 141 of the case 126, as well as alignment tab 20 of front flanged bracket 12 engaging case alignment notch 138. In a like manner, tab alignment 42 of the rear flanged bracket 22 engages within case alignment notch 140 of FIG. 1. Washer alignment pins 60 and 62 of rear washer 44 engage alignment holes 72 and 74 of the rearmost washer 64. In a like manner, alignment pins 76 and 78 engage of washer 64 engage alignment holes 34 and 36 of rear flanged bracket 22.

MODE OF OPERATION

FIG. 1 and FIG. 2 best illustrate the operation of the solenoid 10 of FIGS. 1–4, the present invention, where a suitable source of electrical power, such as 12 volts direct current, is applied to binding posts 112 and 119 to electrically activate the coil 118, thus causing the conical end 144 of the soft steel, magnetic, zinc plated core to be pulled toward and seat itself in the conical shaped surface 104 of the magnetic core seat 96, carrying with it the actuator rod 160 and rod linkage connection hole 162. As long as power is applied to the coil 110, the moveable core will remain seated until the power is interrupted and the core is acted upon by an outside external force, such as an external spring or other device. The snag ring 88 in front groove 82 will contain the core 142 by contact with actuator end surface 146 if the external spring pulls excessively on the actuator rod 160.

The annular Teflon bearings 152 and 154 are heat shrunk into grooves 148 and 150, respectively, during manufacture. The bearings are broad in width, especially the front bearing 152 in order providing a wide, smooth bearing that does not tend to roll up or get caught in any sleeve depressions, such as the front annular groove 84. The Teflon bearings 152 and 154 prevents the zinc coating 166 of the moveable core 142 from coming into direct contact with the stainless steel, non-magnetic sleeve 80, thereby preventing the wearing away, by metal to metal sliding contact, of the zinc plating 166 of moveable case 142. By preservation of this coating 166, and by the use of a stainless steel sleeve, internal rusting or corrosion is kept to an absolute negligible, minimum, if such even occurs, causing the inner surfaces of the sleeve to maintain as smooth a surface as possible. This provides the best efficient operation with the least friction possible, based on the easy sliding action of the Teflon bearings 152 and 154 along and through the smooth non-corroded interior of sleeve 80. This particular design lends itself to applications of switching in refrigeration units for trailer mounted units for trucks.

What is claimed is:

1. Solenoid comprising front and rear flanged brackets including a plurality of holes, washers aligned at each end of said brackets, a non-magnetic stainless steel sleeve positioned between said brackets and secured to said rearward bracket with a bolt assembly and including a magnetic angled conical seat stop core end therein, a collar positioned on an outer side of said forward bracket and aligned with said sleeve, a molded polycarbonate bobbin positioned about said sleeve and between said brackets, a coil wound over said molded polycarbonate bobbin, and a zinc plated soft magnetic core including a front and rear groove, a conical end at a inner end and an actuator rod connected to said core at an outer end of the said core including an expandable pliable rubber cover positioned over said actuator rod and outer non-magnetic stainless steel sleeve and rings of a heat shrinkable low coefficient frictional fluorocarbon Teflon material positioned annularly in each of said annular inner and outer grooves about said core wherein said low coefficient frictional fluorocarbon Teflon rings about the magnetic core slide easily in solenoidal action under severe temperature ranges and conditions within a non-corrosive stainless steel sleeve wherein said solenoid is used for actuating power relay to a refrigeration unit.

* * * * *